US007963090B2

(12) United States Patent
Ours et al.

(10) Patent No.: US 7,963,090 B2
(45) Date of Patent: Jun. 21, 2011

(54) FLEXIBLE FULL PACKAGE DEFLATORS AND FORMER

(75) Inventors: Dave Ours, Marshall, MI (US); Shari Juntunen, Portage, MI (US)

(73) Assignee: Kellogg Company, Battle Creek, MI (US)

( * ) Notice: Subject to any disclaimer, the term of this patent is extended or adjusted under 35 U.S.C. 154(b) by 189 days.

(21) Appl. No.: 12/469,170

(22) Filed: May 20, 2009

(65) Prior Publication Data

US 2009/0288370 A1 Nov. 26, 2009

Related U.S. Application Data

(60) Provisional application No. 61/054,929, filed on May 21, 2008.

(51) Int. Cl.
*B65B 31/00* (2006.01)

(52) U.S. Cl. ..... 53/526; 53/433; 53/512

(58) Field of Classification Search ..... 53/433, 53/434, 451, 511, 512, 551, 526
See application file for complete search history.

(56) References Cited

U.S. PATENT DOCUMENTS

| | | | | |
|---|---|---|---|---|
| 2,257,777 | A | 7/1941 | Anderson | |
| 2,496,906 | A * | 2/1950 | Churchill | 267/230 |
| 2,520,435 | A | 8/1950 | Roman | |
| 2,925,719 | A | 2/1960 | Robbins et al. | |
| 3,533,454 | A | 10/1970 | Tinsley | |
| 3,568,733 | A | 3/1971 | Lau | |
| 3,634,993 | A * | 1/1972 | Pasco et al. | 53/433 |
| 4,084,390 | A | 4/1978 | Schmachtel et al. | |
| 4,215,520 | A * | 8/1980 | Heinzer et al. | 53/173 |
| 4,457,122 | A * | 7/1984 | Atkins et al. | 53/434 |
| 4,676,051 | A * | 6/1987 | Hoskinson et al. | 53/451 |
| 4,947,621 | A | 8/1990 | Christine et al. | |
| 4,964,259 | A | 10/1990 | Ylvisaker et al. | |
| 5,170,609 | A | 12/1992 | Bullock et al. | |
| 5,246,216 | A | 9/1993 | Oberst | |
| 5,514,392 | A * | 5/1996 | Garwood | 426/106 |
| 5,603,284 | A * | 2/1997 | Freedman | 119/28.5 |
| 5,715,656 | A | 2/1998 | Pearce | |
| 6,637,177 | B1 | 10/2003 | Trillich et al. | |
| 7,197,861 | B2 * | 4/2007 | Higer et al. | 53/512 |

FOREIGN PATENT DOCUMENTS

EP 0122864 A1 10/1984

OTHER PUBLICATIONS

International Search Report Dated Sep. 9, 2009, 4 pages.

* cited by examiner

*Primary Examiner* — Sameh H. Tawfik
(74) *Attorney, Agent, or Firm* — Dickinson Wright PLLC

(57) ABSTRACT

A deflator apparatus for use in a form, fill and seal bagging machine to deflate excess air from and form a filled or partially filled package of bulk goods includes a first deflator having a plurality of first flexible bands that extends between a pair of first arms. The apparatus further includes a second deflator having at least one second flexible band that extends between a pair of second arms. The first and second deflators are spaced from one another and movable relative to one another to sandwich the package of bulk goods between the plurality of first flexible bands and the at least one second flexible band to remove excess air from the package and form the package.

18 Claims, 5 Drawing Sheets

FLEXIBLE FULL PACKAGE DEFLATORS AND FORMER

CROSS REFERENCE TO RELATED APPLICATION

This application claims the benefit of U.S. Provisional Patent Application Ser. No. 61/054,929 for FLEXIBLE FULL PACKAGE DEFLATORS AND FORMER, filed on May 21, 2008, which is hereby incorporated by reference in its entirety.

BACKGROUND OF THE INVENTION

1. Field of the Invention

The subject invention relates generally to a deflator apparatus, and more particularly to a deflator apparatus and method for deflating excess air from and forming a filled or partially filled package of bulk goods.

2. Description of the Prior Art

In situations where it is necessary to package a quantity of bulk goods within a sealed package, vertical form, fill and seal bagging machines are well known and widely used. An example of such a machine is disclosed in U.S. Pat. No. 4,697,403 to Simpson et al. Generally, in such machines, a web of flexible film is formed into a package or pouch. The package includes at least one open end. Through the open end of the package, a product is filled from the machine and thereafter sealed in the bag.

If not extracted before the sealing process is complete, undesirable quantities of air will remain within the package after it has been sealed. The excess air which remains in the package after sealing is often problematic. For example, the presence of excess air in the flexible package provides an oxidizing environment. This environment can be detrimental to the contents that are contained in the flexible package. Moreover, ambient air typically contains moisture and such moisture can be detrimental to the contents of the flexible package. In addition, during the course of shipping, the excess air creates an unoccupied volume within the shipping carton or case. When this occurs packages containing bulk goods are no longer supported as well by the carton, and are therefore free to move about, the result of which is often damage to the bulk goods. Further, excess air within the package increases the size of the package which will require larger cartons and cases for the package. In addition, a larger package due to excess air may cause cartoner issues by causing loading jams on the cartoner.

It is known in the art to expel excess air from a package. One example is in U.S. Pat. No. 5,170,609 to Bullock et al. The Bullock patent discloses a deflator apparatus for expelling excess air from a package. The deflator apparatus includes two deflators that are attached to a form, fill and seal bagging machine. Each of the deflators include a flexible wall, fluid-filled bladder that engages and sandwiches the package containing bulk goods to force excess air out of the package. The amount of force applied in the Bullock patent may be adjusted by increasing or decreasing the amount of fluid in the bladder or by producing a bladder having varying thickness so that the pressure applied may vary over different portions of the package.

A second example of expelling excess air from a package is disclosed in U.S. Pat. No. 6,637,177 to Trillich et al. The Trillich patent discloses a deflator apparatus for expelling excess gas from a flexible package. The deflator apparatus includes two deflator halves that are hinged together. When the non-hinged ends are brought together, air is urged from the bottom of the package, which is positioned near the hinged end, toward the top of the package and out. Each deflator half has an inflatable pillow member that may be inflated or deflated to provide varying degrees of compression on the package. Additionally, the deflator may use foam inserts having varying shapes and designs to expel air from the package.

SUMMARY OF THE INVENTION AND ADVANTAGES

The present invention relates to a deflator and forming apparatus for use in a form, fill and seal bagging machine. The apparatus deflates excess air from and forms a filled or partially filled package of bulk goods. The apparatus includes a first deflator having a pair of first arms that extend from a first base to a first distal end. The first arms are spaced to define a first gap between the pair of first arms. A plurality of first flexible bands extend across the first gap and between the first arms. The apparatus further includes a second deflator having a pair of second arms that extend from a second base to a second distal end. The second arms are spaced to define a second gap between the pair of second arms. At least one second flexible band extends across the second gap and between the second arms. The first and second deflators are spaced from one another and movable relative to one another. The first and second deflators sandwich the package of bulk goods between the plurality of first flexible bands and the at least one second flexible band to remove excess air from the package and form the package.

The present invention provides a novel deflator apparatus and method for use in a form, fill and seal bagging machine which will expel air from a package before sealing, while alleviating problems encountered by prior methods and apparatuses.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Figure 1:
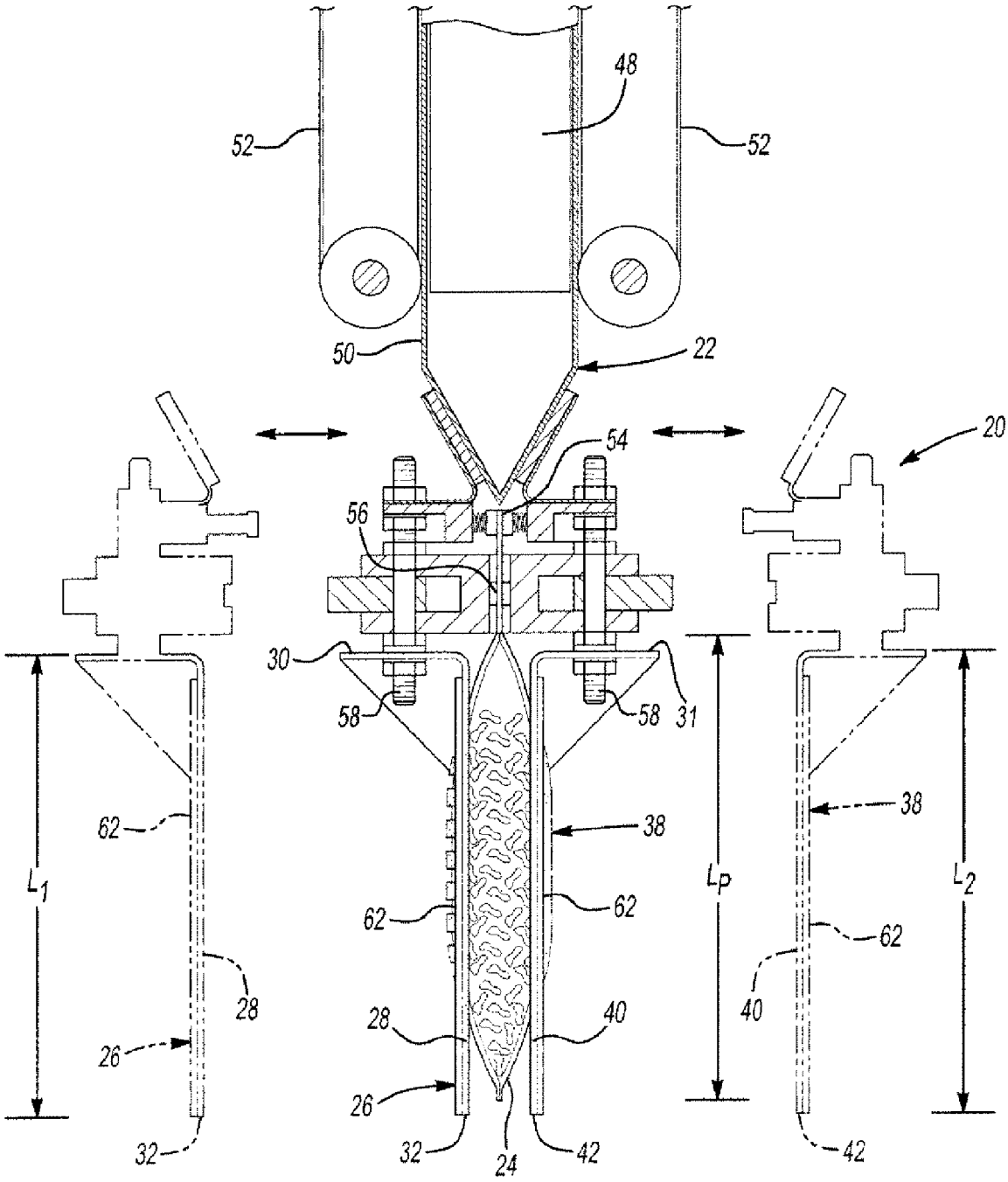
FIG. 1 is a cross-sectional end view of an exemplary deflator apparatus employed with a vertical form, fill and seal bagging machine in its engaged position with its non-engaged position shown in phantom.

Referring to the Figures, wherein like numerals indicate corresponding parts throughout the several views, a deflator apparatus 20 is generally shown for use in a form, fill and seal bagging machine 22 to deflate excess air from and form a filled or partially filled package of bulk goods 24.

Throughout the present specification and claims the phrase "bulk goods" is used as a shorthand version of the wide range of products that can be deflated and formed utilizing the present invention. These items can encompass large bulk packaged pieces as well as very small bulk packaged pieces. Examples of bulk goods include, but are not limited to, the following: agricultural products like seeds, rice, grains, vegetables, fruits; chemical products like fine chemicals, pharmaceuticals, raw chemicals, fertilizers; plastics like plastic resin pellets, plastic parts, rejected plastic parts, machined plastic parts; and cereals and cereal products such as wheat.

A deflator apparatus 20 includes a first deflator 26 generally indicated having a pair of first arms 28 that extend from a first base 30 to a first distal end 32. The first arms 28 are spaced to define a first gap 34 therebetween. A plurality of first flexible bands 36 extend across the first gap 34 and between the first arms 28. The deflator apparatus 20 further includes a second deflator 38 generally indicated having a pair of second arms 40 that extend from a second base 31 to a second distal end 42. The second arms 40 are spaced to define a second gap 44 therebetween. At least one second flexible band 46 extends across the second gap 44 and between the second arms 40.

The first and second deflators 26, 38 are spaced from one another and movable relative to each other. As the first and second deflators 26, 38 are moved into close proximity, the package of bulk goods 24 are sandwiched between the plurality of first flexible bands 36 and the at least one second flexible band 46 to remove excess air from the package and form the package of bulk goods.

Figure 2:
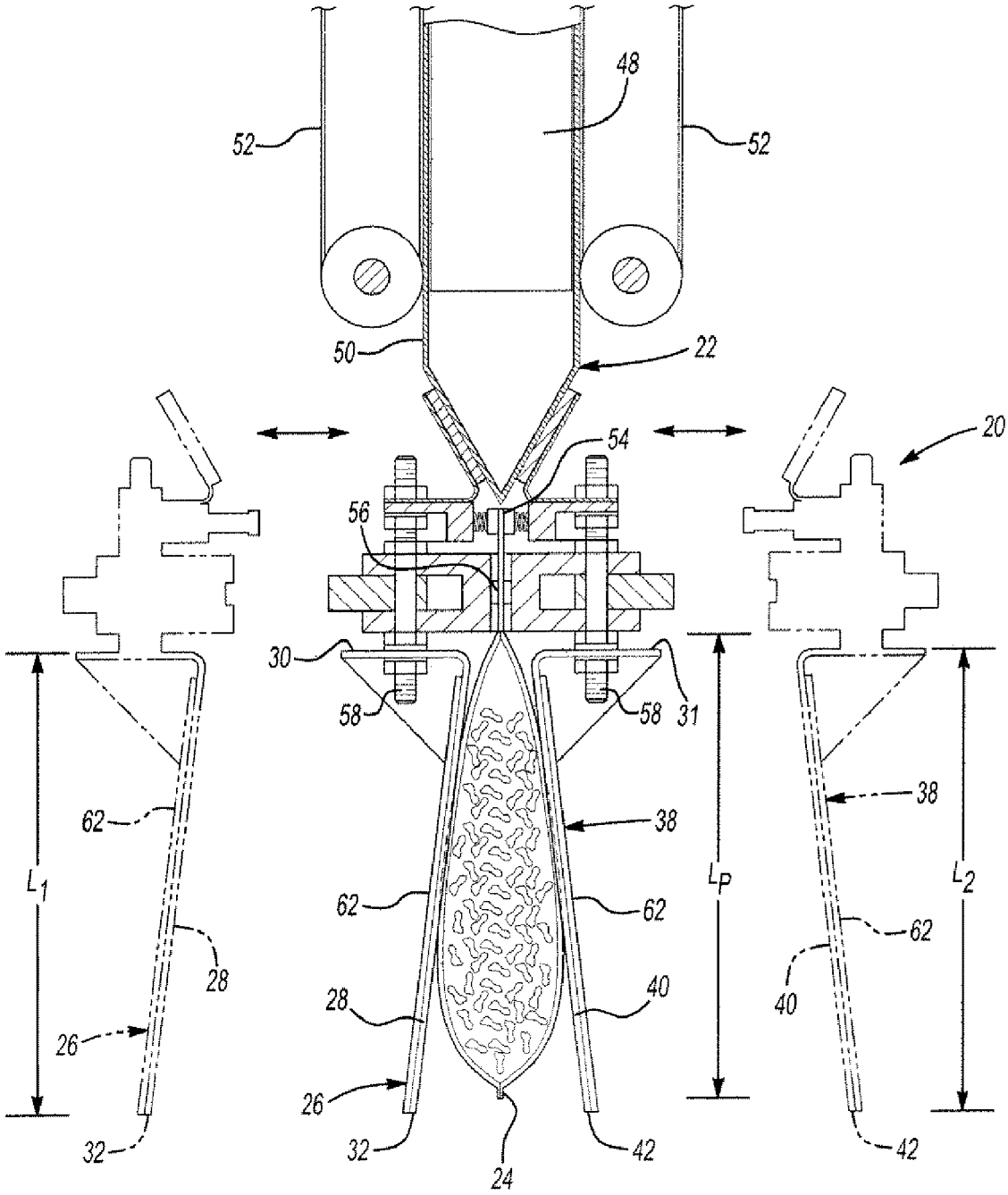
FIG. 2 is a cross-sectional end view of another exemplary deflator apparatus employed with a vertical form, fill and seal bagging machine in its engaged position with its non-engaged position shown in phantom.
Figure 3:
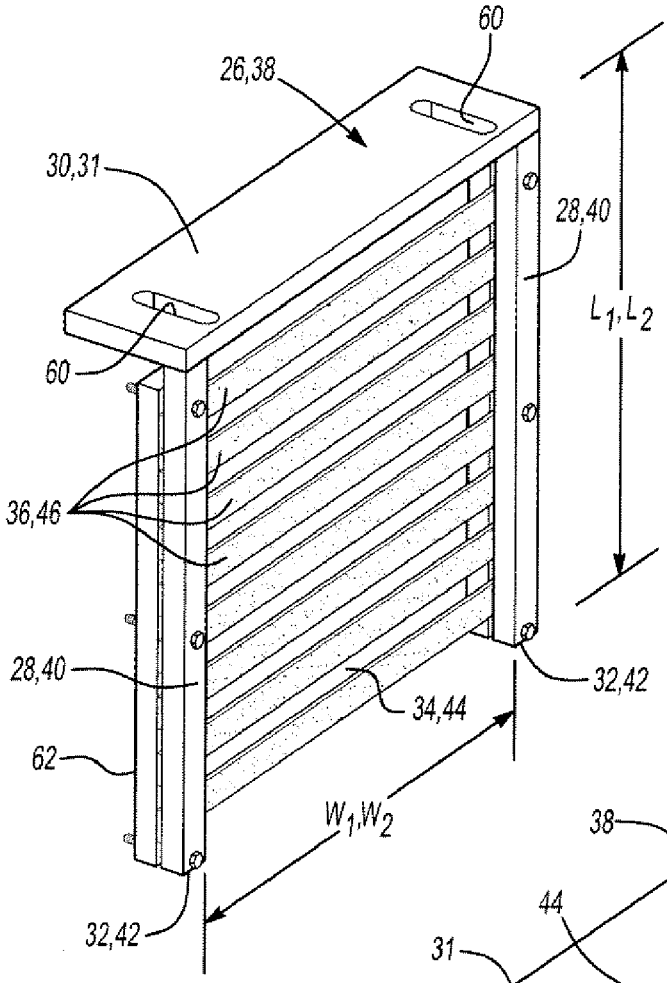
FIG. 3 is a perspective view of an exemplary first or second deflator of the subject invention.

As shown in FIGS. 1 and 2, the deflator apparatus 20 is used with a bagging machine 22 generally indicated. The deflator apparatus 20 may be applied to an existing vertical from, fill and seal bagging machine 22 while in no way adversely affecting the speed of the bagger. Alternatively, the deflator apparatus 20 may be employed with a bagging machine 22, other than that specifically mentioned herein. One such alternative may include, but is not limited to a horizontal form, fill and seal bagging machine 22.

The bagging machine 22 includes a hollow tube member 48 having a sheet of packaging film 50 disposed thereabout. The packaging film 50 is advanced over the tube member 48 by a pair of belt conveyors 52 disposed on opposite sides of the tube member 48 and sealed by a longitudinal sealing device which longitudinally joins the ends of the packaging film 50 to form a package blank. The plurality of bulk goods are fed through the hollow tube member 48 into the package blank to create the package of bulk goods 24 having a package length $L_P$.

The bagging machine 22 includes a first sealing device 54 and a second sealing device 56 that is vertically spaced from the first sealing device 54. The first sealing device 54 creates a bottom seal by sealing the bottom of the package blank to create a package prior to receiving the bulk goods from the tube member 48. The second sealing device 56 seals the top of the package after the bulk goods have been fed into the open end of the package from the tube member 48 and the deflator apparatus 20 has removed the excess air.

The first and second deflators 26, 38 are secured to the bagging machine 22 to move with the bagging machine 22 to sandwich the package of bulk goods 24 between the plurality of first flexible bands 36 and the at least one second flexible band 46. In the exemplary embodiment, a plurality of connecting rods 58 having threaded end portions for accommodating retaining members, such as, threaded nuts extend from the bottom of the second sealing device 56. The connecting rods 58 extend beneath the second sealing devices 56 to engage the first base 30 of the first deflator 26 and the second base 31 of the second deflator 38. The first and second deflators 26, 38 may be secured to the bagging machine 22 by method known in the art.

The deflator apparatus 20 includes a first deflator 26 and a second deflator 38, each being generally L-shaped. The first deflator 26 includes a pair of first arms 28. The first arms 28 are spaced apart and extend downwardly from the first base 30 to the first distal end 32. The first arms 28 are spaced to define a first gap 34 therebetween. In the exemplary embodiment, the first arms 28 extend perpendicularly from the first base 30, but the first arms 28 may be canted, as shown in FIG. 2.

In the exemplary embodiment, the first base 30 defines a plurality of openings 60 that mate with the connecting rods 58 for securing the first deflator 26 to the bagging machine 22. The first deflator 26 is secured to the bottom of the second sealing device 56 by the connecting rods 58 and moves with the second sealing device 56 inwardly and outwardly relative to the second deflator 38. The first deflator 26 may be attached by bolts which secures the first deflator 26 to the second sealing device 56, or by any other means known in the art.

The second deflator 38 includes a pair of second arms 40. In the exemplary embodiment, the second arms 40 extend perpendicularly from the second base 31, but the second arms 40 may be canted, as shown in FIG. 2. The second arms 40 are spaced apart and extend downwardly from the second base 31 to the second distal end 42. The second arms 40 are spaced to define a second gap 44 therebetween. In the exemplary embodiment, the first gap 34 is a first gap width $W_1$ and the second gap 44 is a second gap width $W_2$ different than the first gap width $W_1$ for allowing the first and second deflators 26, 38 to be brought close together in operation.

In the exemplary embodiment, the second base 31 defines a plurality of openings 60 that mate with the connecting rods 58 for securing the second deflator 38 to the bagging machine 22. The second deflator 38 is secured to the bottom of the second sealing device 56 by the connecting rods 58 and moves with the second sealing device 56 inwardly and outwardly relative to the first deflator 26. The second deflator 38 may be attached by bolts which secures the second deflator 38 to the second sealing device 56, or by any other means known in the art.

The first arms 28 have a first length $L_1$ that extends from the first base 30 to the first distal end 32. The second arms 40 have a second length $L_2$ that extends from the second base 31 to the second distal end 42. The first and second lengths $L_1$, $L_2$ can be any length in relation to the package length $L_P$. For example, the first and second length $L_1$, $L_2$ can be less than, greater than, or equal to the package length $L_P$. In the exemplary embodiment, the first and second lengths $L_1$, $L_2$ are at least equal to the package length $L_P$ of the package of bulk goods 24, more preferably, the first and second lengths $L_1$, $L_2$ are greater than the package length $L_P$ of the package of bulk goods 24.

A mounting plate 62 is secured to each of the first and second arms 28, 40 for securing the plurality of first flexible bands 36 to the first arms 28 and the at least one second flexible band 46 to the second arms 40. In the exemplary embodiment, the mounting plate 62 is secured to the first and second arms 28, 40 by the use of a bolt or clamp, but the mounting plate 62 may be secured by any other means known in the art.

As shown in FIGS. 3-5, 7 and 8, the first deflator 26 is composed of a plurality of first flexible bands 36 and the second deflator 38 is composed of at least one second flexible band 46. In the exemplary embodiment, the first and second flexible bands 36, 46 are a flexible material that that is heat resistant and independently adjustable. The flexible material may be rubber, plastic, or any other flexible material known in the art. Different durometer bands 36, 46 can increase or decrease the flexibility and force on the product and form it into any shape. The flexible bands 36, 46 are useful when dealing with bulk goods that are breakable. The flexible bands 36, 46 of the deflator apparatus 20 result in minimal breakage of the bulk goods.

The first deflator 26 includes a plurality of first flexible bands 36 that extend between the first arms 28 of the first deflator 26 and are secured to the first deflator 26 between the each of the first arms 28 and its corresponding mounting plate 62. The plurality of first flexible bands 36 are placed between the first arms 28 and the corresponding mounting plate 62 and held in place when the mounting plate 62 is tightened or secured to the arm. The plurality of first flexible bands 36 may have varying tensions for applying varying pressures along the package of bulk goods 24. In the exemplary embodiment, the tension of the plurality of first flexible bands 36 adjacent the first base 30 is greater than the tension of the plurality of first flexible bands 36 adjacent the first distal end 32. Each of the plurality of first flexible bands 36 may be independently adjustable for altering the amount of excess air that is removed from the package of bulk goods.

Figure 4:
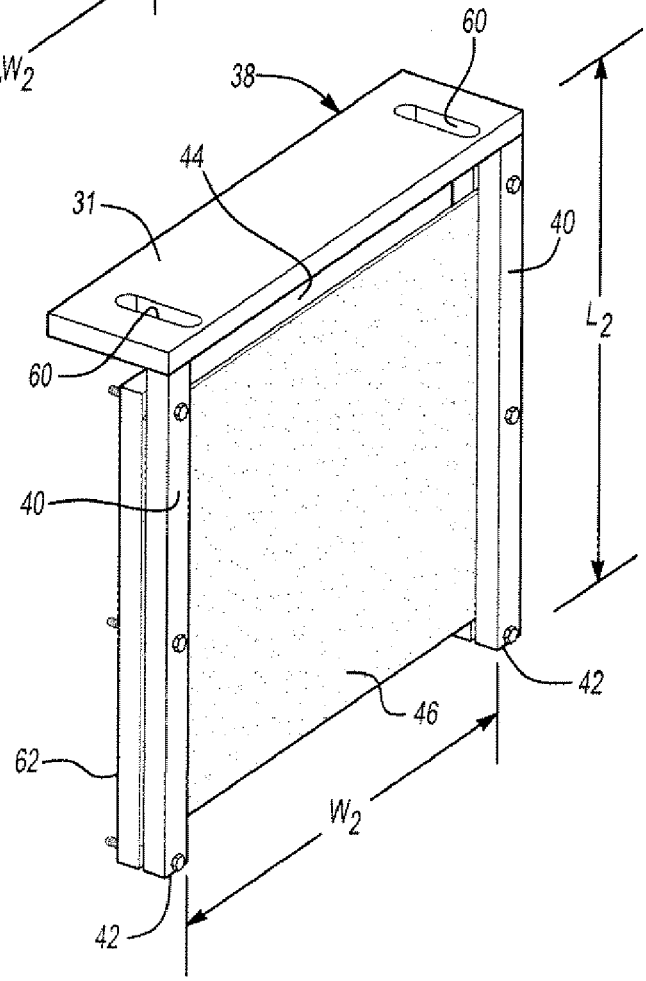
FIG. 4 is a perspective view of another exemplary second deflator of the subject invention.
Figure 5:
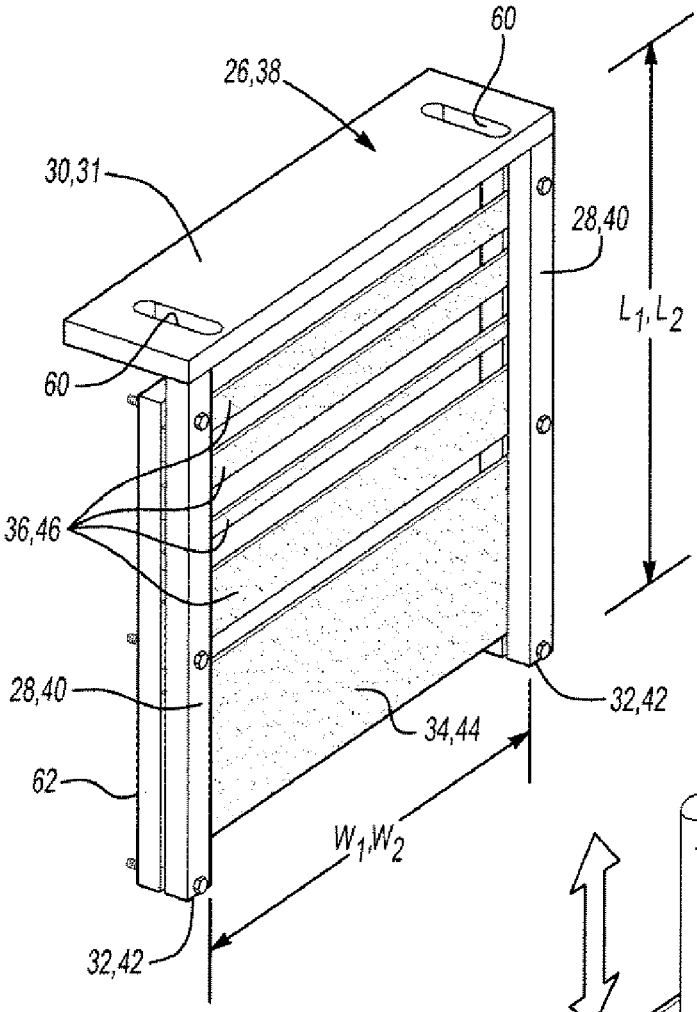
FIG. 5 is a perspective view of another exemplary first or second deflator of the subject invention.

The second deflator 38 includes at least one second flexible band 46 that extends between the second arms 40 of the second deflator 38 and is secured to the second deflator 38 between the each of the second arms 40 and its corresponding mounting plate 62. As shown in FIG. 4, the at least one second flexible band 46 is a single second flexible band or single sheet of flexible material. The tension of the single second flexible band can be constant or may vary. In the exemplary embodiment, the tension of the single second flexible band adjacent the second base is greater than the tension of the single second flexible band adjacent the second distal end.

In an alternative embodiment, the second deflator 38 includes a plurality of second flexible bands 46 that extend between the second arms 40 of the second deflator 38 and are secured to the second deflator 38 between the each of the second arms 40 and its corresponding mounting plate 62. The plurality of second flexible bands 46 are placed between the second arms 40 and the corresponding mounting plate 62 and held in place when the mounting plate 62 is tightened or secured to the arm. The plurality of second flexible bands 46 may have varying tensions for applying varying pressures along the package of bulk goods 24. In the exemplary embodiment, the tension of the plurality of second flexible bands 46 adjacent the second base 31 is greater than the tension of the plurality of second flexible bands 46 adjacent the second distal end 42. Each of the plurality of second flexible bands 46 may be independently adjustable for altering the amount of excess air that is removed from the package of bulk goods.

Figure 8:
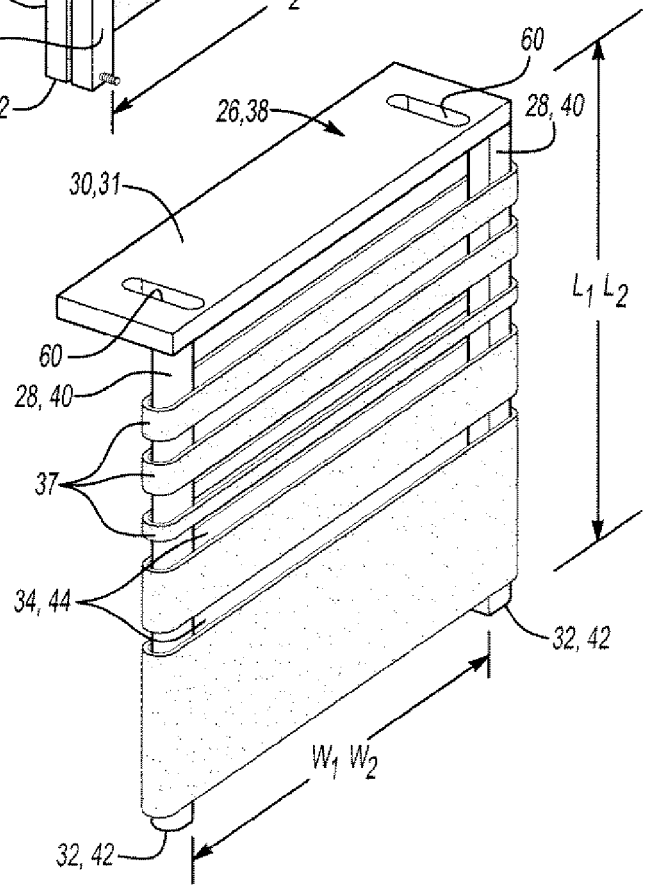
FIG. 8 is a perspective view of another exemplary first or second deflator of the subject invention.

In another exemplary embodiment, as shown in FIG. 8, the first and second bands 36, 46 the first and second deflators 26, 38 may be a plurality of o-ring bands 37 that are disposed around the pair of first or second arms 28, 40 of the first and second deflators 26, 38. The tension in the o-ring bands 37 would secure the o-ring bands 37 to the pair of first or second arms 28, 40. No mounting plate 62 is necessary to secure the o-ring bands 37 to the pair of first or second arms 28, 40. The o-ring bands 37 are a flexible material that that is heat resistant and independently adjustable. The flexible material may be rubber, plastic, or any other flexible material known in the art. Different durometer bands 37 can increase or decrease the flexibility and force on the product and form it into any shape.

In the disclosed embodiment, the flexible bands 36, 37, 46 towards the first and second bases 31 of the first and second deflator 26, 38 will be more taut or tense than the flexible bands 36, 37, 46 at the first and second distal ends 32, 42 of the first and second deflators 26, 38. This is due to the placement of the bulk goods in the package. As bulk goods are introduced into the package they will have a tendency to settle at the bottom of the package, while the top of the package will have more air. Having less taut or tense bands 36, 37, 46 where the bulk goods will settle will result in less damage to the bulk goods as a result of the force applied by the bands 36, 37, 46.

The first and second deflators 26, 38 are easily adjustable and may be adjusted without the use of tools. The flexible bands 36, 37, 46 may be individually adjusted based on the output of the bagging machine 22. The material of the flexible bands 36, 37, 46 may be varied in durometer depending on position. The flexible bands 36, 37, 46 may be adjusted by using flexible bands 36, 37, 46 of different thickness, widths, and tensions. Additionally, the first and second deflators 26, 38 may be adjusted by adjusting the tension of a single flexible band. This is done by simply loosen the mounting plate 62 from one of the first and second arms 28, 40 and adjusting the band as needed and then re-tightening the mounting plate 62 to the first and second arms 28, 40 or when using the o-ring flexible band 37, merely replacing the o-ring flexible band 37 with an o-ring flexible band 37 of a desired tension. The first and second deflators 26, 38 may further be adjusted by canting the arms 28, 40. This is done by moving the distal end of at least one of the pairs of first and second arms 28, 40 either away from the product or toward the product depending on the desired result.

The deflator apparatus 20 forms or shapes the bulk goods in the package and supports the bottom seal of the bag to prevent blow outs of the bottom seal. The shape of the product and breakage can be impacted by the flexibility of the material and the tautness of the flexible bands 36, 37, 46. The first and second deflators 26, 38 contact the package prior to the second seal device allowing for excess air to be removed from the package of bulk goods 24 through an open top prior to sealing. The bands 36, 37, 46 forming around the bulk goods help minimize product in the seal to maintain speed.

Figure 6:
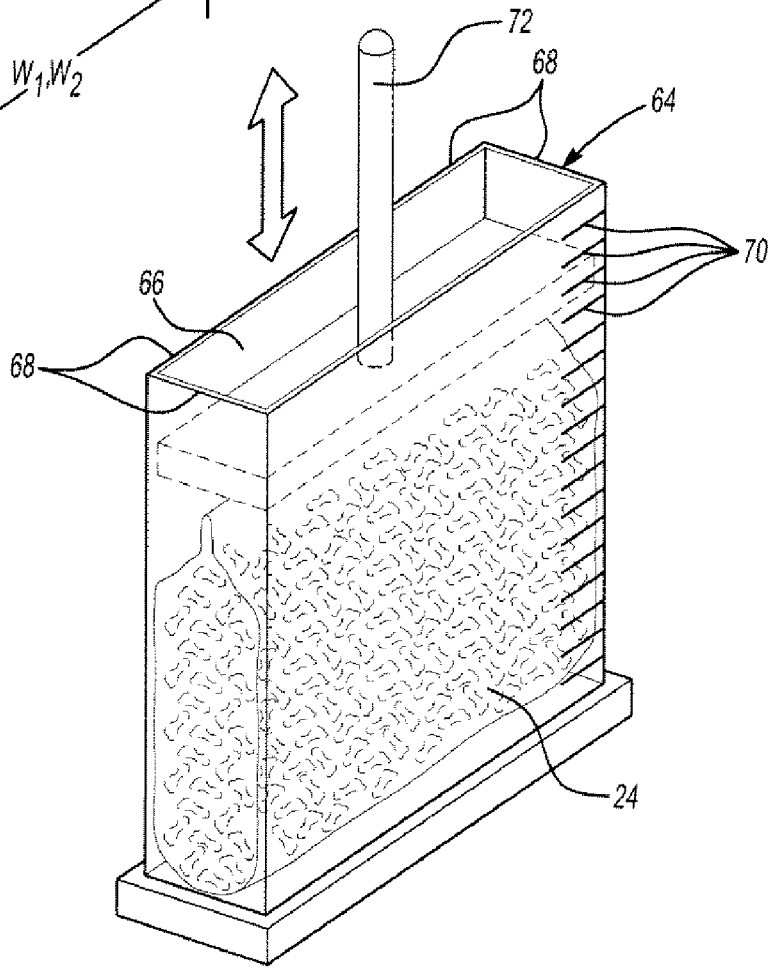
FIG. 6 is a perspective view of a test box used in the subject invention.
Figure 7:
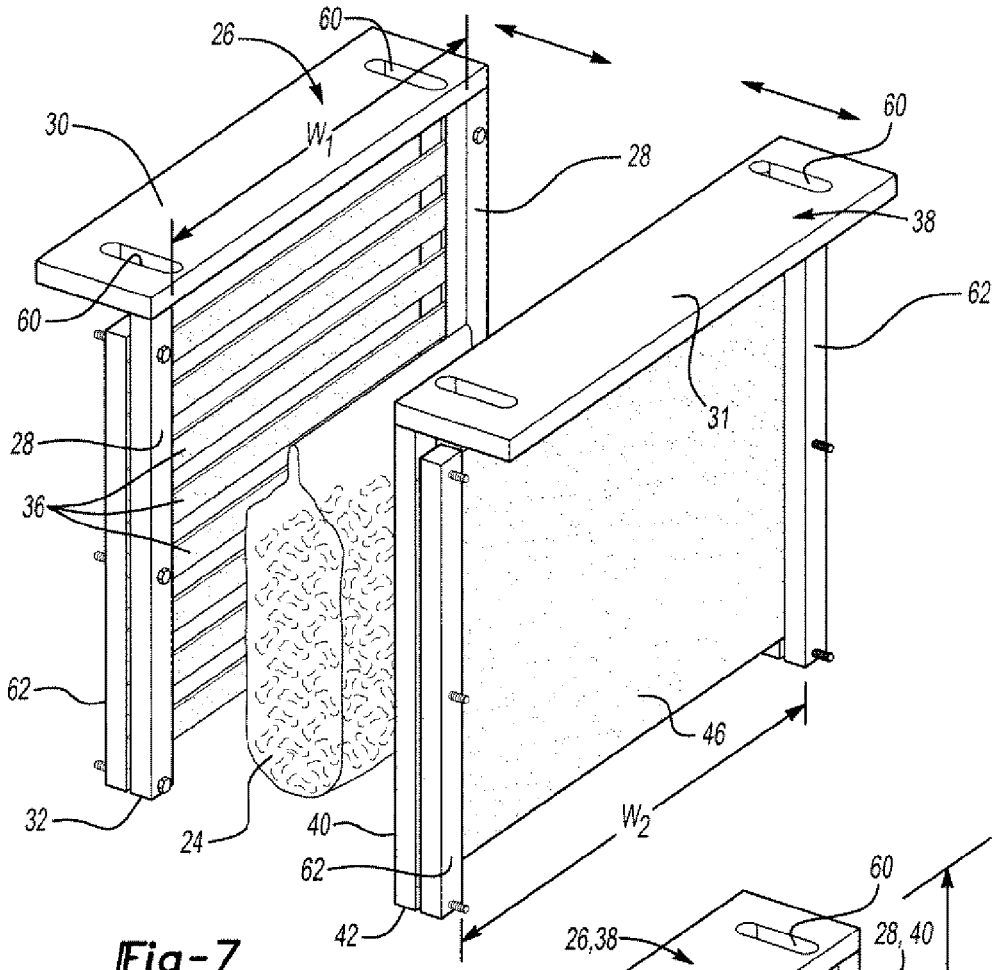
FIG. 7 is a perspective view of the first and second deflator of the subject invention.

As shown in FIG. 6, a test box 64 generally indicated is used to determine or test if the product produced by the deflator apparatus 20 and the vertical form, fill and seal bagging machine 22 has an allowable amount of air therein. Too little air, and the package is more difficult to transform from the circular shape to a rectangular shape. To much air, and the bulk goods will want to settle or not fit.

The test box 64 is a clear plastic box having a test box opening 66 defined by four test box walls 68. The test box 64 includes a measurement scale 70 extending from the bottom of the test box 64 toward the top of one of the test box walls 68. The measurement scale 70 is used to calculate the amount of air within the sample package.

To use the test box 64, a package of bulk goods 24 is placed in the test box 64. A plunger 72 is disposed in the test box opening 66 on top of the package of bulk goods 24 placed in the test box 64. The plunger 72 includes a measuring plate having the same dimensions as the test box opening and a support peg extending upwardly therefrom. The support peg allows the operator to insert and remove the plunger 72 for testing. With the plunger 72 inserted within the test box 64, the operator measures both the level of the top of the bulk goods in the package of bulk goods 24 and the level of the bottom of the plunger 72. The amount of air within the package is measured by calculating the difference between the level of the top of the bulk goods in the package of bulk goods 24 and the level of the bottom of the plunger 72 in the test box 64. Based upon the results of the test box 64, an operator may adjust the bands 36, 37, 46 accordingly as described above to control the amount of air removed from the package of bulk goods.

The test box 64 test how much air is in a desired package. Knowing the desired package size and the size of the box in which the package will be placed the operator may use the test box 64 to test for the amount of air within the package. Based on the amount of air within the desired package, the operator may quickly adjust the first and second deflators 26, 38 to repeatedly produce the desired package of bulk goods 24. The test box 64 provides a quicker and easier way to determine how the flexible bands 36, 37, 46 should be adjusted to produce the desired package of bulk goods 24.

The present invention further provides for a method of deflating excess air from and forming a filled or partially filled package of bulk goods 24. The method begins by first producing a package for bulk goods. The package includes an open top and closed bottom. A plurality of bulk good are then disposed into the open top of the package. Next, the package of bulk goods 24 having the closed bottom and open top are placed between the first deflator 26 the second deflator 38. The first deflator 26 includes a plurality of first flexible bands 36 with each of the first flexible bands 36 having a tension or first flexible band tension. In the exemplary embodiment, the second deflator 38 includes at least one second flexible band 46 with a tension or second flexible band tension. In an alternative embodiment, the second deflator 38 may include a plurality of second flexible bands 46 with each of the second flexible bands 46 having a tension or second flexible band tension.

Excess air is then removed from the package of bulk goods 24. The excess air is removed by moving the first deflator 26 relative to the second deflator 38 to sandwich the package of bulk goods 24 between the plurality of first flexible hands 36 of the first deflator 26 and the at least one second flexible band 46 of the second deflator 38. The open top of the package of bulk goods is then sealed after removing the excess air from the package of bulk goods.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A deflator apparatus for use in a form, fill and seal bagging machine to deflate excess air from and form a filled or partially filled package of bulk goods comprising:

a first deflator having a pair of first arms extending from a first base to a first distal end, said first arms being spaced to define a first gap therebetween;

a plurality of first flexible bands extending across said first gap and between said first arms, each of said plurality of first flexible bands having varying tensions for applying varying pressures along the package of bulk goods;

a second deflator having a pair of second arms extending from a second base to a second distal end, said second arms being spaced to define a second gap therebetween; and at least one second flexible band extending across said second gap and between said second arms;

wherein said first and second deflators are spaced from one another and movable relative to one another for sandwiching the package of bulk goods between said plurality of first flexible bands and said at least one second flexible band to remove excess air from the package and form the package.

2. The apparatus as set forth in claim 1 wherein the tension of said plurality of first flexible bands adjacent said first base is greater than the tension of said plurality of first flexible bands adjacent said first distal end.

3. The apparatus as set forth in claim 1 wherein each of said plurality of first flexible bands is independently adjustable.

4. The apparatus as set forth in claim 1 wherein said first gap is a first gap width and said second gap is a second gap width different than said first gap width for allowing said first and second deflators to be brought close together.

5. The apparatus as set forth in claim 1 further including a plurality of second flexible bands extending across said second gap and between said second arms.

6. The apparatus as set forth in claim 5 wherein each of said plurality of second flexible bands is independently adjustable.

7. The apparatus as set forth in claim 5 wherein said plurality of second flexible bands have varying tensions for applying varying pressures along the package of bulk goods.

8. The apparatus as set forth in claim 7 wherein the tension of said plurality of second flexible bands adjacent said second base is greater than the tension of said plurality of second flexible bands adjacent said second distal end.

9. The apparatus as set forth in claim 1 wherein said first arms extend perpendicularly from said first base and said second arms extend perpendicularly from said second base.

10. The apparatus as set forth in claim 1 wherein at least one of said pair of first and second aims are canted.

11. The apparatus as set forth in claim 1 including a mounting plate secured to each of said first arms for securing said plurality of first flexible bands to said first arms.

12. The apparatus as set forth in claim 1 including a mounting plate secured to each of said second arms for securing said at least one second flexible band to said second arms.

13. The apparatus as set forth in claim 1 further including a bagging machine, said first and second deflators being secured and to said bagging machine to move with said bagging machine for sandwiching the package of bulk goods between said plurality of first flexible bands and said at least one second flexible band.

14. The apparatus as set forth in claim 1 further including a package of bulk goods having a package length, said first arms have a first length extending from said first base to said first distal end and said second arms have a second length extending from said second base to said second distal end, said first and second lengths being at least equal to said package length of said package of bulk goods.

15. The apparatus as set forth in claim 14 wherein said first and second lengths are greater than said package length of said package of bulk goods.

16. The apparatus as set forth in claim 1 wherein the at least one second flexible band is a single second flexible band.

17. The apparatus as set forth in claim 16 wherein the tension of said single second flexible band adjacent said second base is greater than the tension of said single second flexible band adjacent said second distal end.

18. The apparatus as set forth in claim 1 wherein the plurality of first flexible bands and the at least one second flexible band is a rubber material.

* * * * *

UNITED STATES PATENT AND TRADEMARK OFFICE

CERTIFICATE OF CORRECTION

PATENT NO. : 7,963,090 B2
APPLICATION NO. : 12/469170
DATED : June 21, 2011
INVENTOR(S) : Dave Ours and Shari Juntunen It is certified that error appears in the above-identified patent and that said Letters Patent is hereby corrected as shown below:

Column 7, Line 35: “hands” should read -- bands --.

Signed and Sealed this
Fourth Day of October, 2011

David J. Kappos

David J. Kappos
*Director of the United States Patent and Trademark Office*